US009672736B2

(12) United States Patent
Lovell et al.

(10) Patent No.: US 9,672,736 B2
(45) Date of Patent: Jun. 6, 2017

(54) SITE MAP INTERFACE FOR VEHICULAR APPLICATION

(75) Inventors: Jeffrey Clark Lovell, Midland, MI (US); Lorenzo Caminiti, Ann Arbor, MI (US); James Joseph Richardson, Temecula, CA (US); Christopher Thomas Higgins, Placentia, CA (US)

(73) Assignees: Toyota Motor Engineering & Manufacturing North America, Inc., Erlanger, KY (US); Raytheon Company, Waltham, MA (US)

( * ) Notice: Subject to any disclaimer, the term of this patent is extended or adjusted under 35 U.S.C. 154(b) by 745 days.

(21) Appl. No.: 12/403,962

(22) Filed: Mar. 13, 2009

(65) Prior Publication Data

US 2010/0100325 A1 Apr. 22, 2010

Related U.S. Application Data

(60) Provisional application No. 61/107,527, filed on Oct. 22, 2008.

(51) Int. Cl.

| | |
|---|---|
| ***G08G 1/16*** | (2006.01) |
| ***G08G 1/04*** | (2006.01) |
| ***G08G 1/01*** | (2006.01) |
| ***G08G 1/0962*** | (2006.01) |

(52) U.S. Cl.

CPC ..... *G08G 1/04* (2013.01); *G08G 1/0104* (2013.01); *G08G 1/0962* (2013.01); *G08G 1/164* (2013.01)

(58) Field of Classification Search

CPC ..... G08G 5/045; G08G 3/02; G08G 1/166; G08G 1/165; G08G 1/16; G08G 1/163; G08G 1/0104; B60W 30/09; B60W 2550/10; B60W 10/20; B60W 30/095; B60W 30/16; B60W 2550/402; B60W 30/08; B60W 10/18; B60W 30/0956; B60W 30/10

USPC ..... 701/300, 301

See application file for complete search history.

(56) References Cited

U.S. PATENT DOCUMENTS

| | | | | |
|---|---|---|---|---|
| 4,293,857 | A * | 10/1981 | Baldwin | 342/32 |
| 5,646,844 | A * | 7/1997 | Gudat et al. | 701/409 |
| 5,867,804 | A * | 2/1999 | Pilley et al. | 701/120 |
| 6,012,014 | A | 1/2000 | Koyanagi et al. | |
| 6,223,125 | B1 * | 4/2001 | Hall | 701/301 |
| 6,262,679 | B1 * | 7/2001 | Tran | 342/29 |
| 6,470,271 | B2 | 10/2002 | Matsunaga | |
| 6,728,608 | B2 | 4/2004 | Ollis et al. | |

(Continued)

*Primary Examiner* — Maroun Kanaan

(74) *Attorney, Agent, or Firm* — Dinsmore & Shohl LLP

(57) ABSTRACT

A system and method for transferring data between an object detection system and a collision processing circuit is provided. The object detection system includes sensors configured to provide coverage of and detect movement within a predetermined area. The object detection system further includes a path predicting circuit and a plotting circuit operable to predict and plot the location of detected objects. The system further includes a map definition of the predetermined area, a grid system plotted onto the predetermined area, and environmental information relating to the predetermined area, and a series of overlays. Each overlay is plotted with the grid system and the predicted location of the detected objects. The object detection system transmits the map definition and series of overlays to the collision processing circuit so as to determine a probability of a collision.

11 Claims, 8 Drawing Sheets

(56) References Cited

U.S. PATENT DOCUMENTS

| | | | | |
|---|---|---|---|---|
| 6,799,100 | B2 | 9/2004 | Burns et al. | |
| 7,211,980 | B1 * | 5/2007 | Bruemmer et al. | 318/587 |
| 7,386,163 | B2 * | 6/2008 | Sabe et al. | 382/153 |
| 7,423,535 | B2 * | 9/2008 | Chung et al. | 340/572.4 |
| 8,294,594 | B2 * | 10/2012 | Goudy et al. | 340/905 |

* cited by examiner

| | A | B | C | D | E |
|---|---|---|---|---|---|
| 5 | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% |
| 4 | OBJ1-0%<br>OBJ2-0%<br>S.V.-0% | OBJ1-0%<br>OBJ2-0%<br>S.V.-0% | OBJ1-0%<br>OBJ2-0%<br>S.V.-20% | OBJ1-0%<br>OBJ2-0%<br>S.V.-0% | OBJ1-0%<br>OBJ2-0%<br>S.V.-0% |
| 3 | OBJ1-80%<br>OBJ2-0%<br>S.V.-0% | OBJ1-80%<br>OBJ2-0%<br>S.V.-0% | OBJ1-30%<br>OBJ2-0%<br>S.V.-60% | OBJ1-30%<br>OBJ2-50%<br>S.V.-0% | OBJ1-0%<br>OBJ2-60%<br>S.V.-0% |
| 2 | OBJ1-60%<br>OBJ2-0%<br>S.V.-0% | OBJ1-0%<br>OBJ2-0%<br>S.V.-0% | OBJ1-0%<br>OBJ2-0%<br>S.V.-80% | OBJ1-0%<br>OBJ2-80%<br>S.V.-0% | OBJ1-0%<br>OBJ2-80%<br>S.V.-0% |
| 1 | OBJ1-0%<br>OBJ2-0%<br>S.V.-0% | OBJ1-0%<br>OBJ2-0%<br>S.V.-0% | OBJ1-0%<br>OBJ2-0%<br>S.V.-80% | OBJ1-0%<br>OBJ2-0%<br>S.V.-0% | OBJ1-0%<br>OBJ2-0%<br>S.V.-0% |

34

30

32 t = 0.2

Fig-3B

| | A | B | C | D | E |
|---|---|---|---|---|---|
| 5 | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% | OBJ1-0%<br>OBJ2-0%<br>S.V.-0% |
| 4 | OBJ1-0%<br>OBJ2-0%<br>S.V.-0% | OBJ1-0%<br>OBJ2-0%<br>S.V.-0% | OBJ1-0%<br>OBJ2-0%<br>S.V.-20% | OBJ1-0%<br>OBJ2-0%<br>S.V.-0% | OBJ1-0%<br>OBJ2-0%<br>S.V.-0% |
| 3 | OBJ1-60%<br>OBJ2-0%<br>S.V.-0% | OBJ1-80%<br>OBJ2-0%<br>S.V.-0% | OBJ1-40%<br>OBJ2-30%<br>S.V.-40% | OBJ1-30%<br>OBJ2-50%<br>S.V.-0% | OBJ1-0%<br>OBJ2-60%<br>S.V.-0% |
| 2 | OBJ1-0%<br>OBJ2-0%<br>S.V.-0% | OBJ1-0%<br>OBJ2-0%<br>S.V.-0% | OBJ1-20%<br>OBJ2-60%<br>S.V.-80%<br>Threshold | OBJ1-0%<br>OBJ2-80%<br>S.V.-0% | OBJ1-0%<br>OBJ2-80%<br>S.V.-0% |
| 1 | OBJ1-0%<br>OBJ2-0%<br>S.V.-0% | OBJ1-0%<br>OBJ2-0%<br>S.V.-0% | OBJ1-0%<br>OBJ2-0%<br>S.V.60% | OBJ1-0%<br>OBJ2-0%<br>S.V.-0% | OBJ1-0%<br>OBJ2-0%<br>S.V.-0% |

34

30

32 t = 0.4

Fig-3C

| | A | B | C | D | E |
|---|---|---|---|---|---|
| 5 | OBJ1 & SV-0%<br>OBJ2 & SV-0% | OBJ1 & SV-0%<br>OBJ2 & SV-0% | OBJ1 & SV-0%<br>OBJ2 & SV-0% | OBJ1 & SV-0%<br>OBJ2 & SV-0% | OBJ1 & SV-0%<br>OBJ2 & SV-0% |
| 4 | OBJ1 & SV-10%<br>OBJ2 & SV-15% | OBJ1 & SV-05%<br>OBJ2 & SV-15% | OBJ1 & SV-05%<br>OBJ2 & SV-20% | OBJ1 & SV-10%<br>OBJ2 & SV-15% | OBJ1 & SV-0%<br>OBJ2 & SV-0% |
| 3 | OBJ1 & SV-10%<br>OBJ2 & SV-25% | OBJ1 & SV-20%<br>OBJ2 & SV-35% | OBJ1 & SV-40%<br>OBJ2 & SV-35%<br>Threshold | OBJ1 & SV-20%<br>OBJ2 & SV-25% | OBJ1 & SV-05%<br>OBJ2 & SV-15% |
| 2 | OBJ1 & SV-10%<br>OBJ2 & SV-0% | OBJ1 & SV-10%<br>OBJ2 & SV-10% | OBJ1 & SV-25%<br>OBJ2 & SV-30% | OBJ1 & SV-15%<br>OBJ2 & SV-30% | OBJ1 & SV-20%<br>OBJ2 & SV-25% |
| 1 | OBJ1 & SV-0%<br>OBJ2 & SV-0% | OBJ1 & SV-05%<br>OBJ2 & SV-10% | OBJ1 & SV-05%<br>OBJ2 & SV-25% | OBJ1 & SV-05%<br>OBJ2 & SV-25% | OBJ1 & SV-0%<br>OBJ2 & SV-0% |

34

30

32 t = 0.6

Fig-3D

SITE MAP INTERFACE FOR VEHICULAR APPLICATION

CROSS-REFERENCE TO RELATED APPLICATIONS

This application claims priority of U.S. Provisional Patent Application Ser. No. 61/107,527 filed Oct. 22, 2008, which is incorporated herein by reference.

FIELD OF THE INVENTION

The present invention relates to a data transferring system and method for transferring data between an object detection system and a collision processing circuit. More particularly, the present invention relates to a data transferring system and method for transferring data between an object detection system and a collision processing circuit wherein the data includes a transmission of static information relating to the environment of a predetermined area, and subsequent transmissions of dynamic information relating to the movement of detected objects within the predetermined area.

DESCRIPTION OF THE PRIOR ART

Systems for passing information between an object detection system and collision processing circuits themselves are known. For instance, object detection systems currently transmit sensor input relating to a predetermined area to a collision processing circuit. The collision processing circuit processes the sensor information to generate a probability of collision. The object detection system may use sensors such as a camera, a global positioning system (GPS), radar, sonar or the like.

With reference now to FIG. 1, a prior art system for transferring sensor information between an object detection system and the collision processing circuit is provided. All of the sensor information is transferred to a collision processing circuit. The collision processing circuit processes newly inputted sensor information each time the collision processing circuit calculates a collision probability. The more sensor input, the greater the size of data transferred, and the longer the processing time. Processing such information can be complicated and may include consideration of factors such as: the orientation of the predetermined area; any infrastructure located at the predetermined area; the speed and direction of any detected objects; and the like.

The collision processing circuit may be housed locally within the object detection system, within a system vehicle, or remote from both the object detection system and the system vehicle. In any event, the amount of information to be processed is quite large as it includes a static representation of the predetermined area, the predicted paths of the detected obstacles, information from each of the sensors and the like. Such systems require high processing speeds and a large amount of memory in order to provide a timely collision warning.

Accordingly, it is desirable to have a system and method for transferring data between an object detection system and a collision processing circuit that reduces the size of the data transferred so as to reduce the processing time and provide a timely collision warning. It is further desirable to have a data transferring system adaptable to be used by any system wherein an object detection system transmits sensor information to a collision processing circuit for collision prediction.

SUMMARY OF THE INVENTION

A data transferring system and method for transferring data between an object detection system and a collision processing circuit is provided. The object detection system may include a computer processing unit in communication with a plurality of sensors. The computer processing unit is operable to collect and process sensor information.

The sensors are configured to provide coverage of a predetermined area and to detect the movement of objects within the predetermined area. The object detection system further includes a path predicting circuit and a plotting circuit. The path predicting circuit predicts the paths of objects detected within the predetermined area and the plotting circuit plots the predicted location of the detected objects. The object detection system is in communication with the collision processing circuit and may transmit data to the collision processing circuit in cycles of data. The collision processing circuit is in communication with the system vehicle. The collision processing circuit may be housed in the system vehicle or may be located remotely.

Each cycle of data includes a transmission of static information relating to the environment of a predetermined area, and subsequent transmissions of dynamic information relating to the movement of detected objects within the predetermined area. In one embodiment, the transmission of static information includes a map definition, and the subsequent transmissions include a series of overlays.

The map definition includes static environmental information relating to the predetermined area covered by the object detection system. The map definition also includes a grid system plotted onto the predetermined area. The grid system includes a plurality of grid cells. The static environmental information relates to information about the predetermined area that does not change frequently. For instance, the map definition may include the location and orientation of infrastructure located within the predetermined area. The map definition may further include other known factors such as blind spots, and traffic signals such as yield signs and stop signs.

The dynamic information includes a series of overlays. Each of the series of overlays includes a grid system that is uniform to the grid system plotted onto the map definition. The overlays contain dynamic information relating to detected objects within the predetermined area. Specifically, the plotting circuit plots the predicted location of each of the detected objects onto the overlay. Accordingly, each overlay displays the predicted location of each of the detected objects at a specific time in the future.

The overlays are transmitted to the collision processing circuit after the map definition has been transmitted. The collision processing circuit processes the map definition and the overlays to determine a probability of a collision. The collision processing circuit is in communication with a warning system and actuates the warning system when the probability of collision exceeds a predetermined threshold. Thus the data transferring system reduces the data size required for generating a collision warning as compared to current systems which transmit sensor information and map information for processing collision probability. Another advantage is that the data transferring system is adaptable to be used by any system wherein an object detection system transmits sensor information to a collision processing circuit for determining collision probability.

The method of transferring data between an object detection system and a collision processing circuit includes the step of generating a cycle of data, wherein the cycle of data includes a map definition and a series of overlays. The map definition includes a grid system plotted onto the predetermined area covered by the object detection system and information relating to the environment of the predetermined area. The overlays include a grid system uniform to the grid system plotted onto the map definition. The method further includes the step of plotting each overlay with the predicted location of detected objects at a given time. The next step in the method is to transmit the cycle of data to a collision processing circuit. The collision processing circuit is operable to update the map definition with the overlays so as to determine the probability of a collision.

BRIEF DESCRIPTION OF THE DRAWINGS

FIGS. 3*b* and 3*c* show an overlay plotted with the probability of the location of each object in the coverage area of the object detection system at a given time;

FIG. 3*d* shows an overlay plotted with the probability of a collision occurring within each of the grid cells of an overlay.

DETAILED DESCRIPTION OF THE INVENTION

Figure 1A:
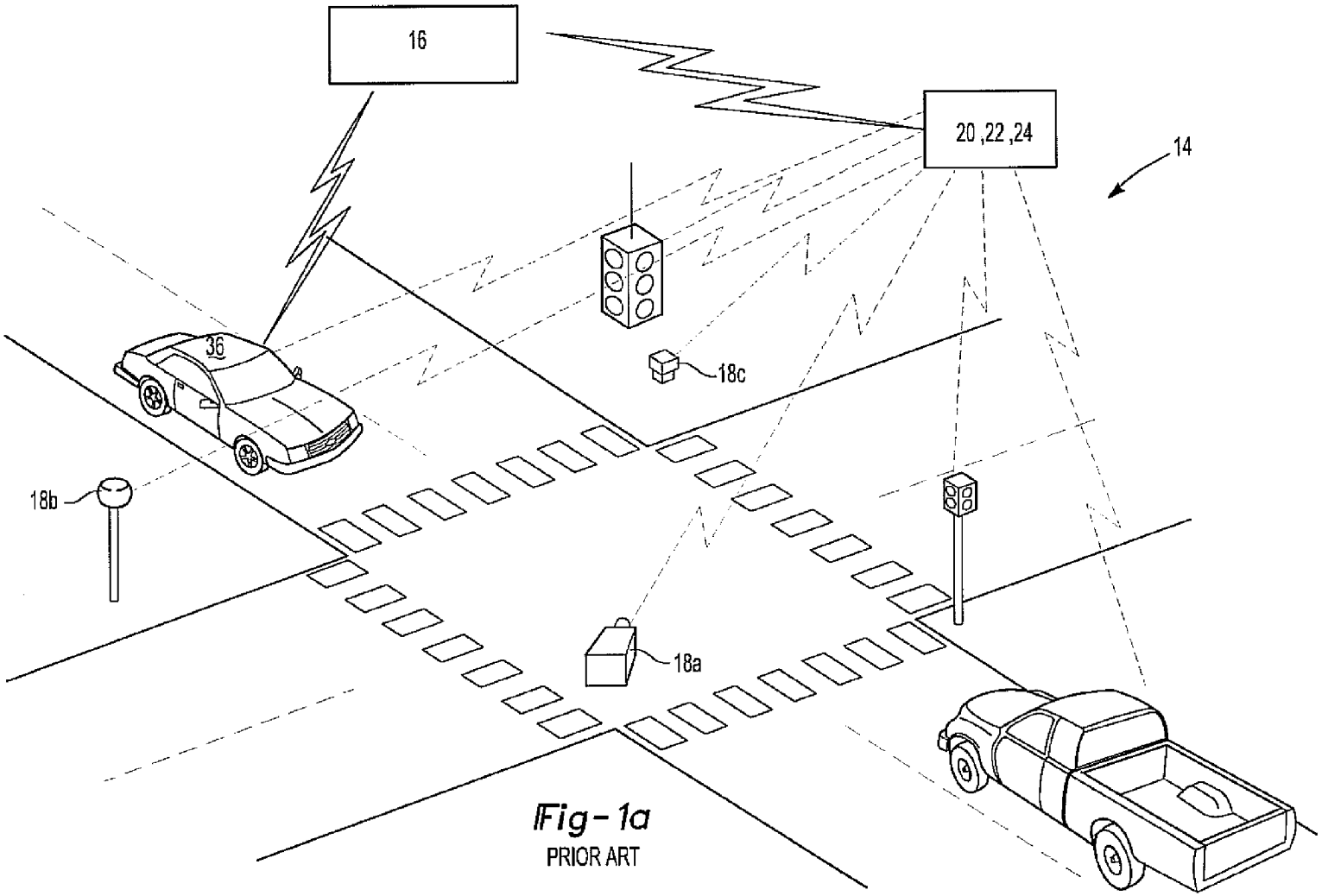
Fig-1a PRIOR ART
FIG. 1*a* is an illustration of a prior art object detection system in communication with a collision processing circuit.
Figure 1B:
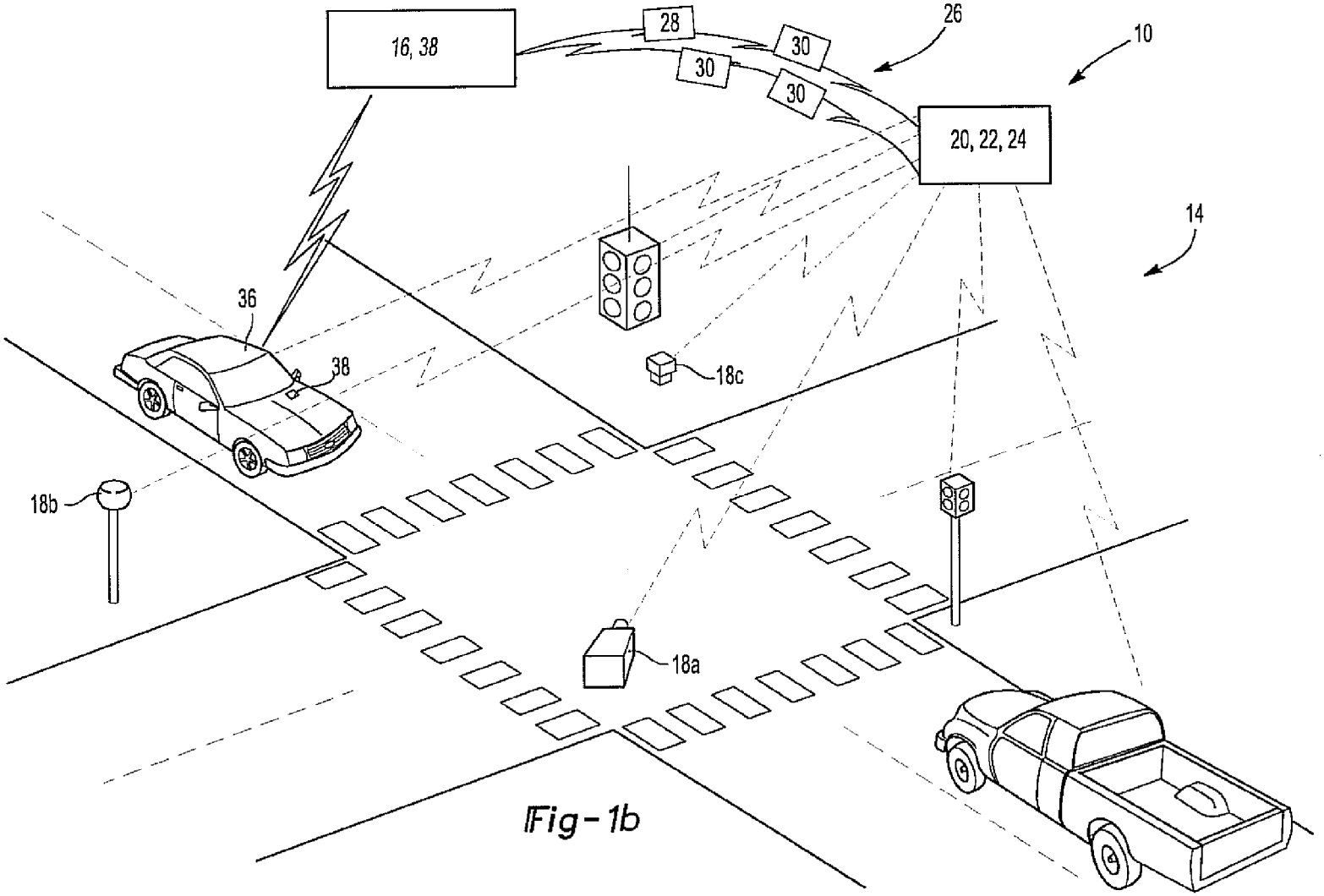
FIG. 1*b* is an illustration of an embodiment of the data transferring system.

The present invention relates to a data transferring system 10 and method 12 for transferring data between an object detection system 14 and a collision processing circuit 16. The object detection system 14 includes a plurality of sensors 18 configured to provide coverage of a predetermined area. The sensors 18 are also configured to detect movement of objects within the predetermined area. For example, the object detection system 14 may include a plurality of cameras 18*a*, a global positioning system 18*b*, and other sensors such as radar 18*c* and sonar. Each sensor 18 is in communication with the object detection system 14.

The object detection system 14 includes a computer processing unit 20 and a path predicting circuit 22. The computer processing unit 20 is operable to collect and process sensor information. For instance, the computer processing unit 20 may filter corrupt or abnormal sensor information and prevent such information from being transmitted to the collision processing circuit 16.

The path predicting circuit 22 processes information gathered by the sensors 18 so as to predict the path of the detected objects within the predetermined area. The object detection system 14 may further include a plotting circuit 24. The plotting circuit 24 plots the predicted location of the detected objects. The object detection system 14 may be housed locally within the predetermined area or may be remote.

The computer processing unit 20 may also be housed locally within the object detection system 14 so as to receive the information from the sensors 18 on site. The information from the sensors 18 may be processed using the path predicting circuit 22 and may be further plotted onto a map using the plotting circuit 24. Alternatively, the object detection system 14 may be remote from the predetermined area. As described above, the camera 18*a* and other sensors 18 may be used to provide coverage for a predetermined area and to detect objects in the area. These sensors 18 are in communication with the remotely located object detection system 14. The object detection system 14 processes the sensor information and transmits the processed information to the collision processing circuit 16 for processing.

The data transferring system 10 includes at least one cycle of data 26. Each cycle of data 26 may include a transmission of static information 28 relating to the environment of a predetermined area, and subsequent transmissions of dynamic information 30 relating to the movement of detected objects within the predetermined area. In one embodiment, the transmission of static information includes a map definition 28, and the subsequent transmissions include a series of overlays 30.

The map definition 28 includes static information relating to the predetermined area of the object detection system 14, and a grid system 32 plotted onto the predetermined area. The grid system 32 is defined by a plurality of grid cells 34. The map definition 28 is directed towards providing comprehensive environmental information concerning the predetermined area that does not change frequently. For example, the map definition 28 may include information relating to the location and orientation of the infrastructure located within the predetermined area; the types of traffic signs and signals such as crosswalk signs, yield signs, and the like; building height, elevation, orientation as well as other environmental data. The object detection system 14 may generate a map definition 28 using collected sensor information or a map definition 28 may be provided to the object detection system 14.

The data transferring system 10 further includes a series of overlays 30. Each of the series of overlays 30 includes a grid system 32. Preferably, the grid system 32 is identical to the grid system 32 provided on the map definition 28 so as to reduce processing time associated with correlating the two grid systems 32. The grid system 32 is plotted over the predetermined area covered by the object detection system 14. The overlays 30 include dynamic information relating to detected objects within the predetermined range. Specifically, the plotting circuit 24 plots the predicted location of each of the detected objects onto the grid system 32 of each of the series of overlays 30.

The map definition 28 and the overlays 30 may include other information to provide static information relating to the environment of the predetermined area and dynamic information relating to the state of a detected object in a future. For instance the signal phase and timing of traffic lights (SPAT) may be sent to the object detection system 14 and utilized in generating both the map definition 28 and the series of overlays 30. SPAT information may be used to provide the map definition 28 with information relating to the operation of traffic signals within the predetermined area. SPAT information may also be used to predict the location of detected objects in the predetermined area. Specifically, SPAT information such as the timing of traffic lights may be used in a mathematical model to help predict the location of the detected objects.

The path predicting circuit 22 predicts the path of the detected objects as well as the path of the system vehicle 38. Any method of path prediction currently known and used in the art may be adaptable for use in the path predicting circuit 22. For instance, the path predicting circuit 22 may generate a path prediction by plotting the velocity and location of the detected object so as to create a vector of each detected object, including the system vehicle 38. In yet another example, the path predicting circuit 22 uses a mathematical model for predicting the location of detected objects at a given time.

The data transferring system 10 transmits a cycle of data 26 to the collision processing circuit 16. The cycle of data 26 includes a first transmission of the map definition 28, and subsequent transmissions of the overlays 30. The map definition 28 is transmitted at an initial time $T_0$. The initial time of transmission may be when the system vehicle 38 enters into the predetermined area of the object detection system 14. In addition, other factors may trigger the initial time of transmission. For instance, the object detection system 14 may be programmed to preclude transmitting cycles of data 26 when there are no objects in the predetermined area other than the system vehicle 38. However, the object detection system 14 may transmit the map definition 28 at an initial time should the object detection system 14 detect another obstacle entering into the predetermined area.

Each overlay in the cycle of data 26 is plotted so as to identify the predicted location of a detected object at $T_{0+i*n}$, where "0" is the time at which the map definition 28 is transmitted, "i" is the interval by which path prediction is generated, and "n" is the number of overlays 30 generated in a cycle of data 26. For example, assume the data transferring system 10 is configured to provide path prediction at 0.2 second intervals after the initial time, and generates four overlays 30 in a cycle of data 26. The first overlay is plotted with the predicted location of detected objects at 0.2 seconds after the map definition 28 has been transmitted. The second overlay is plotted with the predicted location of detected objects at 0.4 seconds after the map definition 28 has been transmitted, and so on until four overlays 30 have been generated. The overlays 30 may be transmitted separately or bundled together with the map definition 28.

The interval in which each of the series of overlays 30 is transmitted may be influenced by factors such as the speed at which the system vehicle 38 is operating, the number of detected objects within the predetermined area, and the like. For example, if the system vehicle 38 and the detected objects are traveling at a speed of less than 20 miles per hour, the interval by which the overlays 30 are generated may be greater than if the system vehicle 38 and detected object are traveling at a speed greater than 20 miles per hour.

In another example, the interval at which the overlays 30 are generated may be shortened even further if there are more than three detected objects within the predetermined area and at least one of those detected objects is within a predetermined distance to the system vehicle 38. Another factor that could affect the interval in which the overlays 30 are generated is the geographic size of the predetermined area of coverage. Thus, if the predetermined area of coverage is 500 square feet, the overlays 30 may be generated at an interval of 0.2 seconds whereas if the predetermined area of coverage is 1,000 square feet, the interval at which each of the overlays 30 is generated is 0.3 seconds. Likewise, the number of overlays 30 generated is also influenced by environmental factors. For instance, the number of overlays 30 desired may be influenced by the speed of the system vehicle 38 and the detected objects as well as the geographic size of the predetermined area of coverage.

This flexibility allows the data transferring system 10 to be tunable, meaning the data transferring system 10 can generate overlays 30 based upon the needs of the system vehicle 38. The needs of the system vehicle 38 may be influenced by factors such as the size of the predetermined area, the speed of the objects detected within the predetermined area, and the speed at which the system vehicle 38 is traveling. For instance, where the speed limit of the geographic location is 35 miles per hour and the road is a two-lane road, it may be desirable to predict collisions for periods which occur three seconds after the system vehicle 38 has entered into the predetermined area. Thus, the frequency at which the overlays 30 are generated may be lesser than if the geographic area speed limit was 50 miles per hour. Likewise, the number of overlays 30 generated might be less in an area where the speed limit is 35 miles per hour as opposed to an area where the speed limit is 50 miles per hour.

After the cycle of data 26 is generated, the data transferring system 10 may then transmit the cycle of data 26 to a collision processing circuit 16. The data transferring system 1 0 may generate and transmit multiple cycles of data 26 to the collision processing circuit 16. The number of cycles of data 26 generated may be influenced by such factors as the presence of the system vehicle 38 within the predetermined area of coverage, thus ensuring that the system vehicle 38 is provided with a collision warning while in the predetermined area. After a collision processing circuit 16 has received the first cycle of data 26 from the object detection system 14, subsequent cycles of data 26 may be limited to just a transmission of overlays 30 so as to further reduce the size of data transfer. This is preferable since the map definition 28 of a predetermined area may not change significantly while the system vehicle is within the predetermined area. Accordingly, a subsequent cycle of data 26 may include a map definition 28 when the environmental information relating to the predetermined area of coverage of the object detection system 14 has changed.

The collision processing circuit 16 may be housed within the object detection system 14, the system vehicle 38, or offsite. The collision processing circuit 16 processes the cycle of data 26 to determine a probability of a collision. The collision processing circuit 16 is in communication with a warning system 36, and actuates the warning system 36 if the collision processing circuit 16 determines that the probability of collision exceeds a predetermined value.

The warning system 36 may be housed in the system vehicle 38 or the object detection system 14. Any warning system 36 currently known and used in the art is adaptable for use herein, illustratively including a digital display mounted on the dashboard of a system vehicle 38, a light mounted to a post located in the predetermined area operable to flash when a potential collision exists, or a device such as a speaker operable to send an audible warning to people within the predetermined area.

With reference now to FIGS. 2*a*-2*d*, an embodiment of the path predicting circuit 22 is provided. The path predicting circuit 22 is operable to generate path predictions using path predicting methods currently known and used in the art. For illustrative purposes, the path predicting circuit 22 uses the location and velocity of the detected objects so as to produce a vector for each detected object. For illustrative purposes, also assume that the cycle of data 26 includes three overlays 30 generated at 0.1 second intervals after the initial time the map definition 28 is transmitted.

Figure 2A:
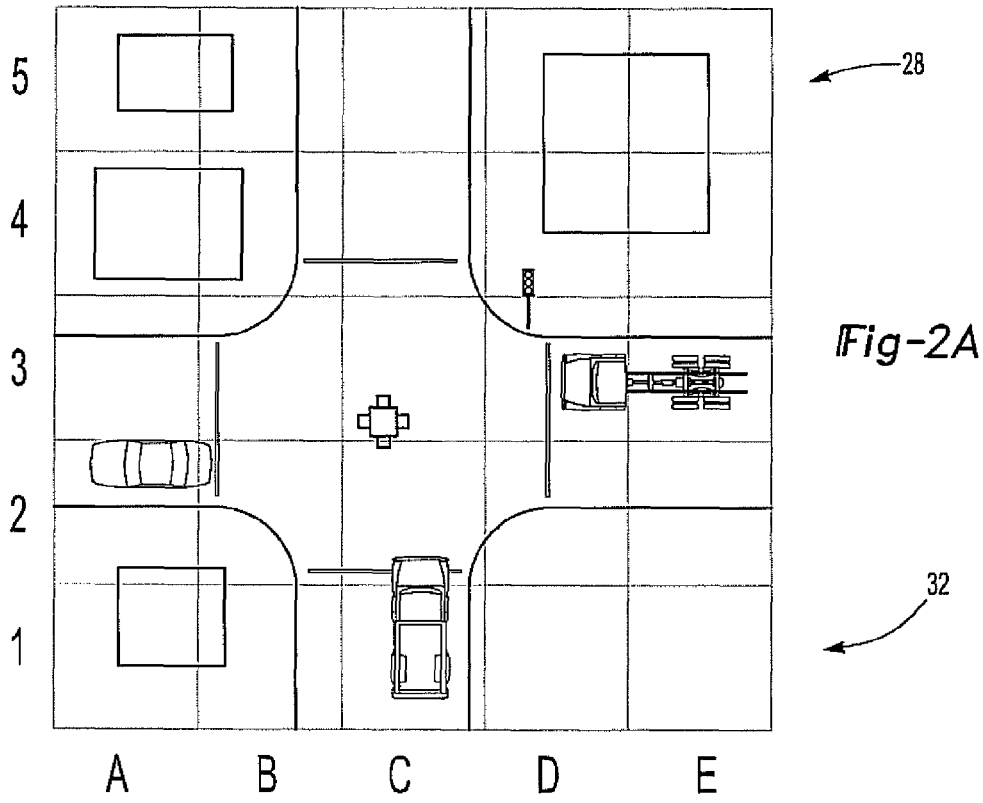
FIG. 2*a* is an illustration of a map definition showing the static environmental information that may be included in the map definition.
Figure 2B:
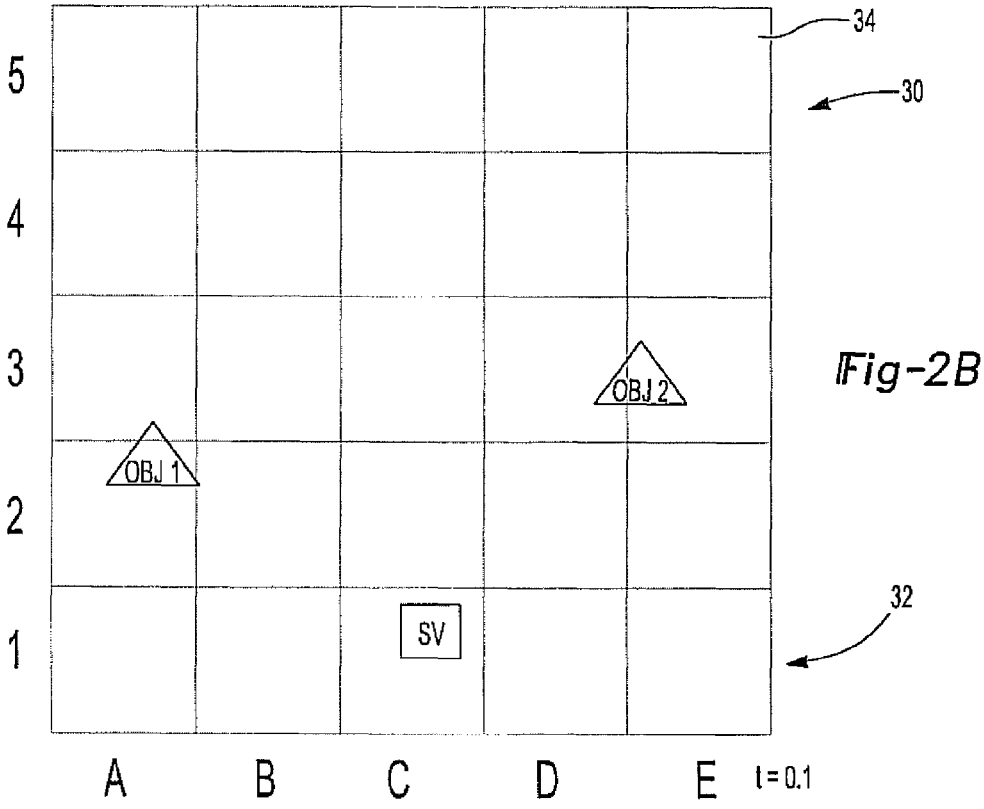
FIGS. 2*b*-2*d* shows an embodiment of dynamic information, wherein the dynamic information is plotted onto an overlay showing the predicted location of objects within the predetermined area of the object detection system at a predetermined time in the future.
Figure 2C:
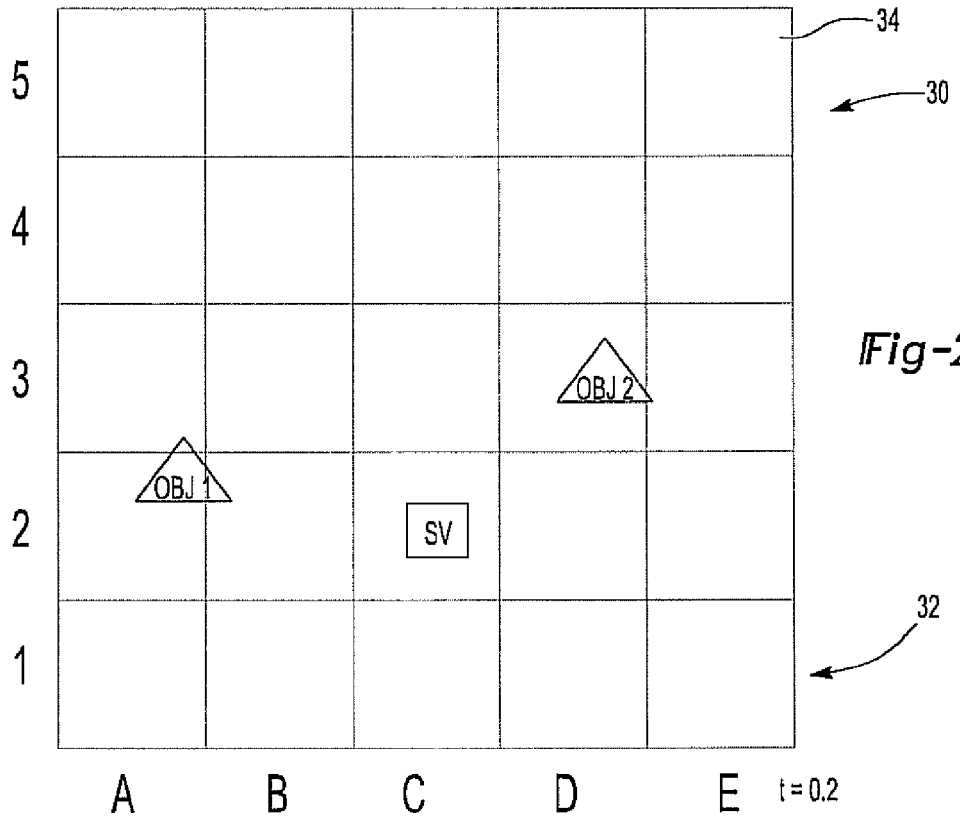
Figure 2D:
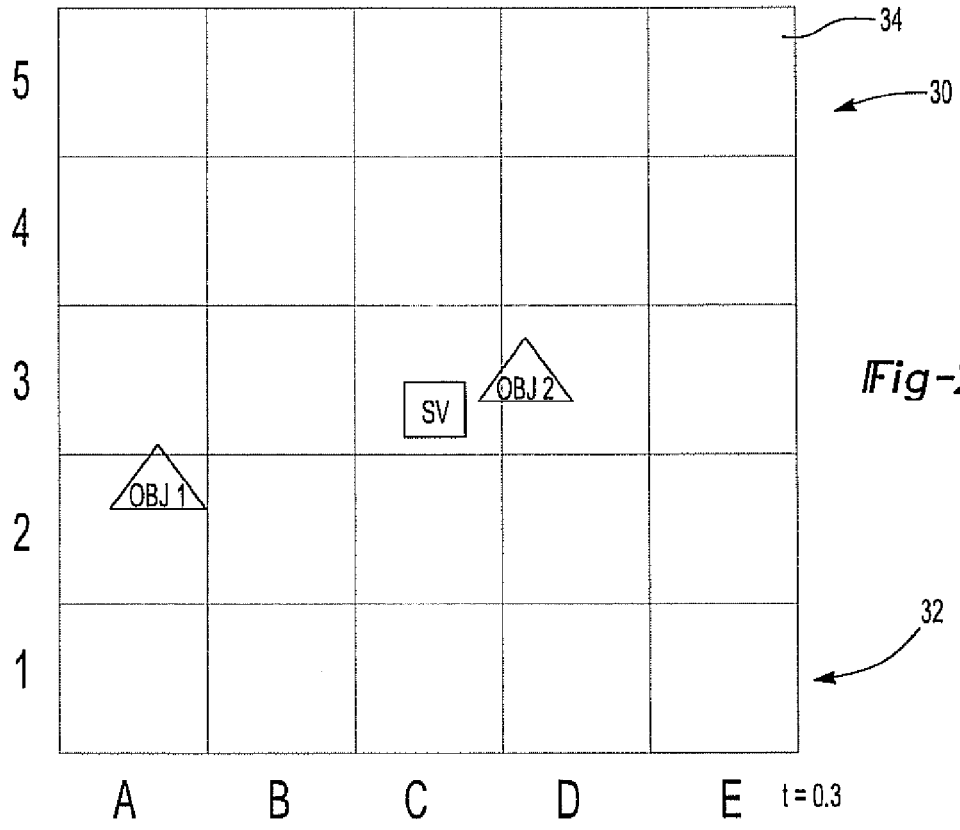

With reference to FIG. 2*a*, a first map definition 28 is provided. With reference to FIG. 2*b* the first overlay in the series is provided. The first overlay shows the predicted location of two detected objects, and the system vehicle 38, referenced as $OBJ_1$, $OBJ_2$ and SV respectively, at 0.1 seconds after the map definition 28 is transmitted. FIG. 2*c* shows the second overlay in the series and the predicted location of $OBJ_1$, $OBJ_2$ and SV at 0.2 seconds after the map definition 28 is transmitted. FIG. 2*d* shows the third overlay in the series and the predicted location of $OBJ_1$, $OBJ_2$ and SV at 0.3 seconds after the map definition 28 is transmitted.

The overlays 30 may be transmitted in a cycle of data 26 to the collision predicting circuit. The collision processing circuit 16 processes the map definition 28 and the series of overlays 30 to determine a probability of a collision. For instance, the collision processing circuit 16 generates vectors for each detected object and the system vehicle 38. The plotting circuit 24 plots each overlay with the predicted location of the detected objects. Specifically, each overlay 30 is plotted with the predicted location of the detected objects at a given time using the generated vector information. Accordingly, the collision processing circuit 16 analyzes the overlay 30 shown in FIG. 2*d* and notices that at grid cell C3, the system vehicle and $OBJ_1$ will probably collide if both maintain their respective course and speed. Accordingly, the collision processing circuit 16 may actuate the warning system 36 so as to warn the system vehicle of the potential collision, and even recommend action to avoid the collision.

Figure 3A:
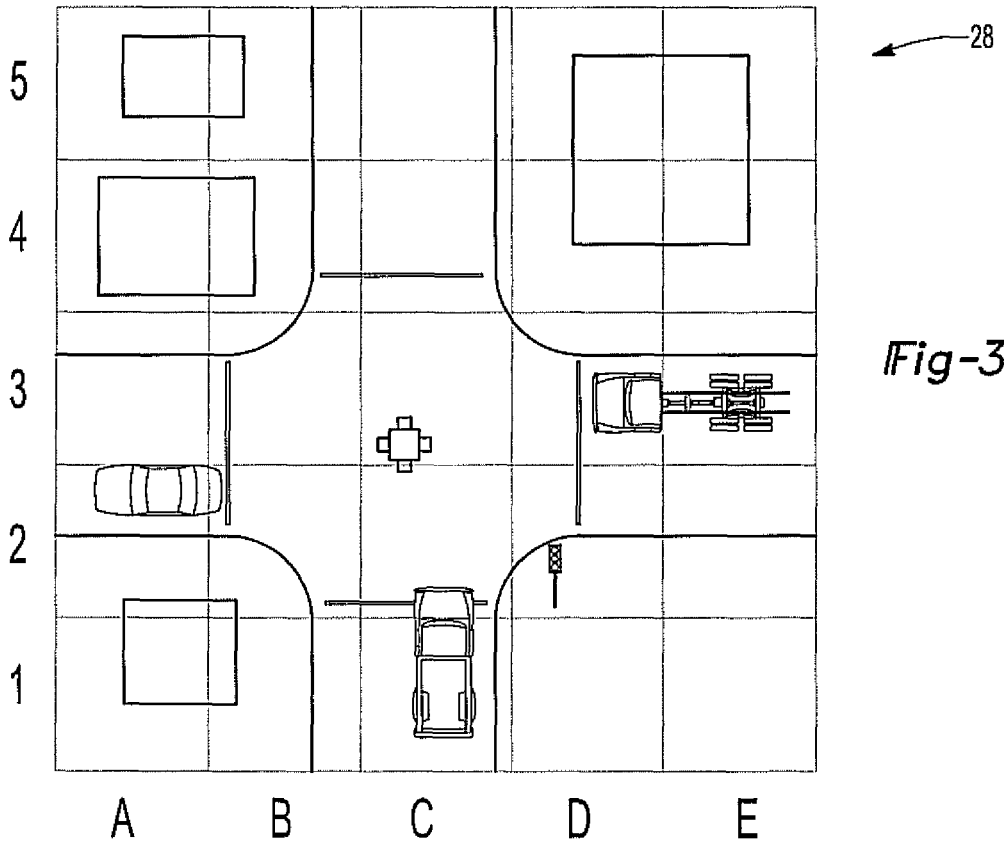
FIG. 3*a* is an illustration of a map definition of a cycle of data, the map definition shows the static environmental information that may be included in the map definition.

With reference to FIGS. 3*a*-3*c* another embodiment of a path predicting circuit 22 is provided. In this embodiment, the path predicting circuit 22 uses mathematical models for predicting object location. The mathematical models may use current information such as object location and velocity as an initial condition. The current information is computed to assert the state of the object at a time in the future. The path predicting circuit 22 may also use environmental data relating to the predetermined area. For instance, factors such as the signal phase and timing of traffic lights, the speed limit of the roadways, and traffic signs may be incorporated into the mathematical model.

The predicted path of an object and the system vehicle 38 is annotated within each of the grid cells 34 in each of the overlays 30. For illustrative purposes, the cycle of data 26 includes a series of three overlays 30, each overlay displays the predicted location of detected objects $OBJ_1$ and $OBJ_2$ at 0.2 second intervals after the initial time the map definition 28 is transmitted, wherein the map definition 28 is transmitted at $T_0$. The map definition 28 includes the location of the system vehicle (SV) and the detected objects at $T_0$.

With reference now to FIG. 3*b*, the predicted paths of two objects at $T_{0.2}$, referenced as $Obj_1$ and $Obj_2$ respectively, are plotted on the overlay showing the predicted path of the first and second detected objects. The path predicting circuit 22 is operable to provide the probability of any of the detected objects in a particular grid cell at $T_{0.2}$. For instance, the overlay shows that there is a 30 percent probability that $OBJ_1$ will be in grid cell C3 at $T_{0.2}$, an 80 percent probability that $OBJ_2$ will be in grid cell D2 at $T_{0.2}$. Likewise, FIG. 3*c* shows the probability of the detected objects in each of the grid cell at $T_{0.4}$. The cycle of data 26 is transmitted to the potential collision circuit. The collision processing circuit 16 processes each overlay to determine if there is a potential collision.

In yet another embodiment of the data transferring system 10, the collision processing circuit 16 includes an aggregating circuit 38. The aggregating circuit 38 includes a threshold 40, the threshold 40 may be scaled to accommodate different scenarios. For example, when there are only two objects detected in the predetermined area, the threshold 40 may be lower than when four objects are detected. The aggregating circuit 38 calculates the probability of the objects predicted to be in each of the grid cells 34 at any given time so as to give a sum total of the probability of objects present in each of the grid cells 34 at the same time.

For example, with reference again to FIG. 3*c* the path predicting circuit 22 has determined that the probability of $OBJ_2$ being in grid cell C2 at $T_{0.4}$ is 60 percent and the probability of the system vehicle (SV) being in grid cell C2 at $T_{0.4}$ is 80 percent. Thus, the aggregating circuit calculates the total of the probability present in grid cell C2 using known probability calculations. For instance, the probability of a collision in grid cell C2 may be expressed by the function $P(OBJ_2 \text{ or } SV)=P(OBJ_2)+P(SV)-P(OBJ_2 \text{ and } SV)$, wherein $P(OBJ_2 \text{ and } SV)=P(OBJ_2)*P(SV)$. Using the expression above, the calculated probability of $OBJ_2$ and SV being in grid cell C2 is 92 percent.

For illustrative purposes, assume that threshold 40 is 90 percent probability when three objects are detected, and any value under 90 percent is discarded. The collision processing circuit 16 will actuate the warning systems 36 where there are values equal to or greater than threshold 40 present in any of the overlays 30. Thus, grid cell C2 meets the threshold for a potential collision and the collision processing circuit 16 actuates the warning system 36 so as to warn the system vehicle 38, or any other vehicles or pedestrians in the predetermined area of the object detection system 14.

Alternatively, the collision processing circuit 16 may process the predicted paths to determine the probability of a collision in each of the grid cells 34 between at least two detected objects, in each of the overlays 30. The aggregating circuit 38 is operable to calculate the probability of a collision in each of the grid cells 34, and the collision processing circuit 16 is operable to actuate the warning system 36 when the probability of a collision exceeds a threshold.

With reference now to FIG. 3*d*, the collision processing circuit 16 has determined that there is a 40 percent chance that the system vehicle 38 will collide with OBJ1 in grid cell C3 at $T_{0.4}$, and a 35 percent chance that the system vehicle 38 will collide with OBJ2 in grid cell C3 at $T_{0.4}$. For illustrative purposes, assume that threshold 40 is 60 percent. Neither of the predicted probabilities of collision alone exceeds the threshold, and accordingly would not generate a warning. However, the aggregating circuit aggregates the probability of collision in grid cell C3 so as to provide a 61 percent probability that a collision will exist in that grid. Assuming the threshold 40 is 50 percent, the collision processing circuit 16 will actuate the warning system 36.

A general illustration of an embodiment of the operation of the data transferring system 10 is provided forthwith. The object detection system 14 is in communication with each of its plurality of sensors 18 so as to detect the movement of an object within a predetermined area. The path predicting circuit 22 processes sensor information so as to predict the path of each of the detected objects, and the plotting circuit 24 plots the dynamic information onto each of the overlays 30. As the system vehicle 38 enters within the predetermined area, the data transferring system 10 transmits a cycle of data 26 to the collision processing circuit 16 at To. The collision processing circuit 16 processes the cycle of data 26 and alerts the system vehicle 38 if the probability of a collision exceeds a threshold 40. For example, the overlays 30 may be plotted onto the map definition to determine the probability of collision. The data transferring system 10 may continue to generate cycles of data 26 for transmission to the collision processing circuit 16 until the system vehicle 38 leaves the predetermined area of the object detection system 14.

The map definition 28 is generated at $T_0$ and includes the predetermined area of the object detection system 14 and a grid system 32 plotted onto the predetermined area. The transmission of the map definition 28 is relatively larger in size than the overlays 30 as the map definition 28 includes information related to the infrastructure present within the predetermined area as well as orientation of roadways, the existence of blind spots, the signal phase and timing of traffic lights and crosswalks and the like.

The object detection system 14 then generates the first of the overlays 30 in the cycle of data 26. The first overlay 30 includes dynamic information relating to die detected objects within the predetermined area at $T_{0+i*n}$. It is anticipated that the overlays 30 may be transmitted individually or collectively. Preferably, the overlays 30 are transmitted individually so as to distribute processing time. The collision processing circuit 16 may process the dynamic information plotted onto each overlay 30 along with static information contained in the map definition 28 so as to determine the probability of a collision, wherein if the probability of collision exceeds the threshold, the warning system 36 is actuated. Thus, the data transferring system 38 reduces the size of data transferred between the object detection system 14 and a system vehicle while still providing dynamic information relating to object detection and path prediction so as to reduce the processing time for generating a collision warning. Furthermore, the data transferring system 10 may be integrated into object detection systems 14 transmitting sensor information to collision processing circuits 16 without significant modification to either the object detection system 14 or collision processing circuit 16. Rather, integration of the data transferring system 10 requires relatively simple programming.

Figure 4:
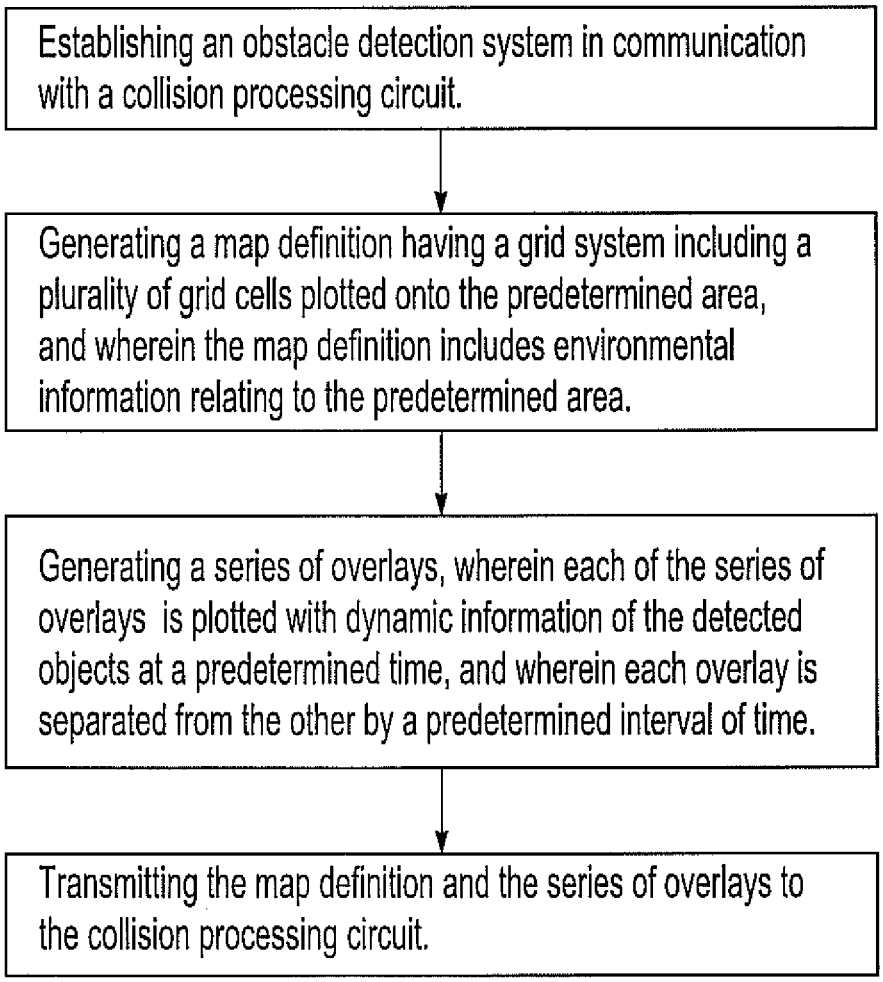
FIG. 4 shows the steps for a method of transferring data between an object detection system and a collision processing circuit so as to predict a collision.

With reference now to FIG. 4, a method 12 of transferring data between an object detection system 14 and a collision processing circuit 16 is provided. The object detection system 14 is in communication with a plurality of sensors 18 operable to provide coverage over a predetermined area and to detect objects within the predetermined area. The method 12 includes the step of establishing an object detection system 14 in communication with a collision processing circuit 16. The method 12 also includes the step of generating a cycle of data 26. The cycle of data 26 includes a transmission of static information 28 relating to the environment of the predetermined area, and subsequent transmissions of dynamic information 30 relating to the movement of detected objects within the predetermined area. In one embodiment, the transmission of static information 28 includes a map definition 28, and the subsequent transmissions of dynamic information 30 include a series of overlays 30.

The map definition 28 includes a grid system 32 plotted onto the predetermined area of the object detection system 14, and also includes information relating to the environment of the predetermined area. The overlays 30 also include a grid system 32. Preferably, the grid system 32 is uniform to the grid system 32 plotted onto the map definition 28. The method 12 further includes the step of predicting the path of each detected object in the predetermined area, and plotting each overlay with the predicted location of detected objects at a given time. The next step in the method 12 is to transmit the cycle of data 26 to a collision processing circuit 16. Thus the processing time for predicting a collision is shortened relative to current systems that transfer all sensor information each time a collision prediction is generated. Specifically, the collision processing circuit 16 only processes environmental information once, and then uses supplemental dynamic information relating to the detected objects to determine the probability of a collision. Furthermore, the data transferring system 10 is adaptable for use in any system wherein sensor information is transmitted to a collision processing circuit 16 for collision prediction.

Obviously, many modifications and variations of the present invention are possible in light of the above teachings and may be practiced otherwise than as specifically described while within the scope of the appended claims.

The invention claimed is:

1. A system for use in an automotive vehicle, the automotive vehicle having a warning system, the system configured to transfer data so as to reduce processing time by the automotive vehicle, the automotive vehicle having an object detection system having a plurality of sensors configured to detect moving objects within a predetermined area, the predetermined area centered around the object detection system so as to change with the movement of the object detection system, the object detection system further including a path predicting circuit and a plotting circuit, the path predicting circuit predicts the path of each of the detected objects within the predetermined area, the plotting circuit plots the predicted location of the detected objects, and a collision processing circuit in communication with the object detection system, the collision processing circuit processing the predicted location of the detected objects and the predicted location of the automotive vehicle to determine the probability of a collision, the system comprising:

a map definition uploaded into the system, the map definition including the predetermined area of the object detection system, the map definition further includes static environmental information relating to the predetermined area, wherein the static environmental information is environmental information which is not capable of movement, wherein the static environmental information includes signal phase and timing of traffic lights, identified blind spots, traffic signals, the location and orientation of roadside infrastructure and the orientation and dimension of terrain located within the predetermined area; wherein the map definition is transmitted from the object detection system to the collision processing circuit at a beginning of a predetermined period, the collision processing circuit processing the map definition; and a series of overlays, each overlay in the series of the series of overlays consisting of a grid system plotted onto the predetermined area of the object detection system, wherein each overlay in the series of overlays is separated from the other by a predetermined interval of time, the grid system is defined by a plurality of grid cells, and the object detection system first uploads the map definition and processes the static environmental information relating to the predetermined area, the plotting circuit sequentially plotting the location of the detected objects and the predicted location of the detected objects onto each overlay in the series of overlays so as to generate distinct overlays, each of which is plotted with dynamic information for a discrete period of time, the dynamic information being objects detected by the object detection system, the collision processing circuit sequentially processing each of the plotted overlay in the series of overlays with the uploaded map definition, processing the static information along with dynamic information plotted on the corresponding overlay so as to calculate a probability of a collision in each grid cell of an overlay of the predetermined area at any given time, wherein the warning system issues a warning when the collision processing circuit generates a predetermined probability of a collision.

2. The system as set forth in claim 1, further including at least one cycle of data transmitted by the object detection system to the collision processing circuit, wherein the at least one cycle of data includes the series of overlays.

3. The system as set forth in claim 2, further including an aggregation circuit operable to calculate the probability of a collision in each of the grid cells of the grid system of each of the series of overlays.

4. The system as set forth in claim 3, further including a threshold, wherein the collision processing circuit is operable to filter each grid cell having a value lower than the threshold from further processing, and wherein the collision processing circuit generates a collision prediction when any of the series of overlays includes a value greater than or equal to the threshold.

5. The system as set forth in claim 1, further including a warning system in communication with the collision predicting circuit, wherein the warning system is operable to provide a warning when the collision processing circuit generates a predetermined probability of a collision.

6. The system as set forth in claim 2, wherein the at least one cycle of data further includes the map definition, and wherein the map definition is first processed by the collision processing circuit.

7. A method for transferring data between an object detection system and a collision processing circuit disposed within an automotive vehicle, the automotive vehicle further including a warning system, wherein the object detection system includes a plurality of sensors configured to detect objects within a predetermined area of the automotive vehicle, the predetermined area centered around the object detection system so as to change with the movement of the object detection system, and wherein the plurality of sensors are also configured to detect the movement of the objects within the predetermined area, and wherein the object detection system further includes a path predicting circuit and a plotting circuit, and wherein the path predicting circuit predicts the path of the detected objects within the predetermined area and the plotting circuit plots the predicted location of the detected objects at a given time, and wherein the object detection system is in communication with the collision processing circuit, the method comprising the steps of:

uploading a map definition, the map definition including static environmental information of the predetermined area, wherein the static environmental information is environmental information which is not capable of movement, wherein the static environmental information includes signal phase and timing of traffic lights, identified blind spots, traffic signals, a grid system having a plurality of grid cells plotted onto the predetermined area, and wherein the map definition includes static environmental information relating to the predetermined area, the static information includes the location and orientation of roadside infrastructure and the orientation and dimension of terrain located within the predetermined area;

generating a series of overlays, having a plurality of overlays, each overlay in the series of overlays consisting of a grid system consisting of a plurality of grid cells plotted onto the predetermined area of the object detection system, wherein each overlay in the series of overlays is separated from the other by a predetermined interval of time;

gathering dynamic information from the plurality of sensors at a predetermined period of time, and sequentially plotting the dynamic information onto a respective overlay of the series of overlays;

first uploading the map definition to the collision processing circuit, wherein the map definition is processed, and subsequently transmitting the series of overlays to the collision processing circuit, wherein the collision processing circuit is operable to sequentially update the map definition with the each overlay in the series of overlays so as to determine a probability of a collision within each of the grid cells; and generating a cycle of data, wherein the cycle of data includes the series of overlays, and wherein each of the series of overlays is separated from the other by a predetermined interval of time, wherein the map definition is uploaded at the beginning of each cycle of data, wherein a new map definition is uploaded when the automotive vehicle leaves the predetermined area, the warning system issuing a warning when the collision processing circuit generates a predetermined probability of a collision.

8. The method as set forth in claim 7, further including the step of providing a location and orientation of infrastructure located within the predetermined area, a signal phase and timing of traffic lights located within the predetermined area, identified blind spots present in the predetermined area, and traffic signals to the map definition.

9. A data transmission system for use in an automotive vehicle having a warning system, the data transmission system directed towards providing data used for determining a probability of a collision comprising:

an object detection system having a plurality of sensors configured to provide coverage of a predetermined area, the plurality of sensors operable to detect the movement of objects within the predetermined area, the predetermined area centered around the object detection system so as to change with the movement of the object detection system, the object detection system further including a path predicting circuit and a plotting circuit, the path predicting circuit predicts the path of each of the detected objects within the predetermined area, the plotting circuit plots the predicted location of the detected objects;

a collision processing circuit in communication with the object detection system, the collision processing circuit operable to process the predicted location of the detected objects to determine the probability of a collision;

a map definition uploaded into the system, the map definition including the predetermined area of the object detection system, the map definition further includes static environmental information relating to the predetermined area, wherein the static environmental information is environmental information which is not capable of movement, the static information includes signal phase and timing of traffic lights, identified blind spots, traffic signals, the location and orientation of roadside infrastructure and the orientation and dimension of terrain located within the predetermined area, and wherein the map definition is transmitted from the object detection system to the automotive vehicle at a predetermined time, the collision processing circuit processing the map definition; and a series of overlays, each overlay in the series of overlays consisting of a grid system plotted onto the predetermined area of the object detection system, wherein each overlay of the series of overlays is separated from the other by a predetermined interval of time, wherein the grid system is defined by a plurality of grid cells and wherein each overlay in the series of overlays further includes the plotted location of the detected objects gathered by the plurality of sensors at a predetermined time, and wherein the object detection system first uploads the map definition and then sequentially transmits the each overlay in the series of overlays to the collision processing circuit, the collision processing circuit updating the map definition with each of the overlays, updating the map definition with the location of the detected objects on each of the overlays so as to determine the probability of a collision within a given grid cell of the predetermined area, wherein the warning system issues a warning when the collision processing circuit generates a predetermined probability of a collision.

10. The data transmission system as set forth in claim 9, further including at least one cycle of data transmitted by the object detection system to the collision processing circuit, wherein the at least one cycle of data includes the series of overlays.

11. The data transmission system as set forth in claim 9, wherein the static information further includes the location of blind spots signal phase and timing of traffic lights.

* * * * *